US007441512B2

(12) United States Patent
Swallow et al.

(10) Patent No.: US 7,441,512 B2
(45) Date of Patent: Oct. 28, 2008

(54) BOOKMARK

(76) Inventors: Brandt S. Swallow, 7068 Hillcrest Ct., Johnston, IA (US) 50131; Joseph Bruce Swallow, 7068 Hillcrest Ct., Johnston, IA (US) 50131; Cinda E. Swallow, 7068 Hillcrest Ct., Johnston, IA (US) 50131

( * ) Notice: Subject to any disclaimer, the term of this patent is extended or adjusted under 35 U.S.C. 154(b) by 220 days.

(21) Appl. No.: 11/436,806

(22) Filed: May 18, 2006

(65) Prior Publication Data

US 2007/0266926 A1 Nov. 22, 2007

(51) Int. Cl.
*B42D 9/00* (2006.01)

(52) U.S. Cl. ..... 116/235; 116/236

(58) Field of Classification Search ..... 116/234, 116/235, 236, 237, 238, 239, 240, 321, 322, 116/323, 324; 281/42; D19/34
See application file for complete search history.

(56) References Cited

U.S. PATENT DOCUMENTS

| | | | | | |
|---|---|---|---|---|---|
| 727,572 | A | * | 5/1903 | Bauer | 116/235 |
| 1,008,481 | A | * | 11/1911 | Lopes | 116/235 |
| 1,619,756 | A | * | 3/1927 | Pearson et al. | 116/323 |
| 2,598,792 | A | * | 6/1952 | Heine | 116/323 |
| 2,630,777 | A | * | 3/1953 | Wilhelm | 116/235 |
| D170,467 | S | * | 9/1953 | Kremin | D19/34 |
| 2,716,390 | A | * | 8/1955 | Goins | 116/235 |
| 3,137,269 | A | * | 6/1964 | Sager | 116/235 |
| 4,932,351 | A | | 6/1990 | Capamaggio | |
| 5,081,948 | A | * | 1/1992 | Walsh | 116/235 |
| 5,305,706 | A | | 4/1994 | Arjomand | |
| 5,325,811 | A | * | 7/1994 | Miroyan | 116/235 |
| 5,437,240 | A | * | 8/1995 | Miroyan | 116/235 |
| D362,016 | S | * | 9/1995 | Faulkingham | D19/34 |
| 5,713,606 | A | * | 2/1998 | Kleinberg et al. | 281/42 |
| 5,803,012 | A | | 9/1998 | Kamen | |
| 5,911,442 | A | * | 6/1999 | Olson | 283/36 |
| 6,015,166 | A | | 1/2000 | May | |
| 6,796,266 | B1 | | 9/2004 | Castillo | |
| 6,994,052 | B1 | * | 2/2006 | McMullen | 116/235 |
| 2004/0099204 | A1 | | 5/2004 | Nestor | |
| 2006/0011125 | A1 | | 1/2006 | Polly | |

FOREIGN PATENT DOCUMENTS

| | | | | |
|---|---|---|---|---|
| CH | 667623 | A5 | * | 10/1988 |
| DE | 3836615 | A1 | * | 5/1990 |

* cited by examiner

*Primary Examiner*—R. A. Smith
(74) *Attorney, Agent, or Firm*—McKee, Voorhees & Sease, P.L.C.

(57) ABSTRACT

An improved bookmark for indicating to a user the location where the user was previously reading in a piece of literature having a plurality of pages and a plurality of lines. The bookmark has a position indicator for indicating to the user where to position the bookmark on the page and a line indicator slidably mounted on the bookmark for marking the line where the user was previously reading by sliding the line indicator along the bookmark.

8 Claims, 4 Drawing Sheets

10
20
12
1E–1E 26
12
24
12
32
25
24
18
18
20

10
24
25
14
24
32
22
20
16

12
18
29
30
26
24
25
32
16
14
28
29
10
20

1D
29
30
26
10
24
25
14
24
28
29
32
22
12
18
16
1D 3E-3E 3D
3D

BOOKMARK

BACKGROUND OF THE INVENTION

The present invention relates to bookmarks and more particularly pertains to an improved bookmarking device for marking the line where the user was previously reading by sliding a line indicator along the bookmark.

The use of a bookmark to mark where the reader was previously reading is known in the prior art. U.S. Pat. No. 6,796,266 to Castillo describes a bookmarking device having a marking membrane on a panel member for marking the appropriate indicia relating to the position on the pages of the literature where the reader previously left off. Another type of bookmark is described in U.S. Pat. No. 6,015,166 to May. May discloses a bookmark that clenches a sheaf of pages to indicate to the reader where the reader was previously reading. U.S. published patent application number 2004/0099204 discloses a clasp for placing on a sheet of a printed document for calling out a specific line of text within the printed document.

What is needed is a bookmark formed by a panel having a reference point for positioning the marker on the page of literature and having a line indicator that specifically identifies the line where the reading was previously reading. Additionally, a bookmark is needed where the line indicator is contained with the width of the bookmark to prevent movement or shifting of the line indicator except by the user. Furthermore, an economical bookmark is needed having a panel member and line indicator having a decorative design and the line indicator being shaped to point exactly to the line in the literature where the user was previously reading.

Thus, a bookmark quickly and accurately marks where the reader left off, prevents rereading of the literature, provides structural and decorative features aimed at enhancing appeal and usability, but is in keeping with economy of scales, fills this previously unmet need.

BRIEF SUMMARY OF THE INVENTION

Therefore it is a primary object, feature, or advantage of the present invention to improve over the state of the art.

It is a further object, feature, or advantage of the present invention to provide an improved bookmark having a line indicator body contained within the periphery of the panel member to discourage unwanted and unintended movement of the line indicator body with respect to the panel member.

It is a still further object, feature, or advantage of the present invention to provide a low cost, economical, and reliable means of marking the line in a piece of literature where the user was previously reading.

Another object, feature, or advantage of the present invention to provide an improved bookmark that provides for quick and easy marking of the line where the user was previously reading.

Yet another object, feature, or advantage of the present invention to provide an improved bookmark that provides indicia and decorative designs positioned on the bookmark and/or line indicator body associated with the literature.

A further object, feature, or advantage of the present invention to provide an improved bookmark that provides an indicator for repositioning the bookmark with respect to the page within the literature for indicating to the user exactly where the user was previously reading.

It is a further object, feature, or advantage of the present invention to provide a means of firmly attaching a line indicator body to the bookmark to prevent unwanted shifting or translation of the line indicator body with respect to the bookmark.

Another object, feature, or advantage of the present invention is to provide an improved bookmark that is easy to fabricate.

The improved bookmark of the present invention is for indicating to a user the location where the user was previously reading in a piece of the literature having a plurality of pages and a plurality of lines. The bookmark includes a panel member having a top end, a bottom end, a front side and an opposite back side for positioning between the plurality of pages in the piece of literature. A position indicator is located on the front side near the top end of the panel member for indicating to the user where to position the panel member on the page. The panel member has at least one slit. A line indicator body is slidably mounted using the slit. By sliding the line indicator along the panel member the line indicator marks the line where the user was previously reading.

According to another feature of the present invention, the slit includes a pair of parallel slits on the panel member and the line indicator body includes a plurality of slits forming the shape of an 'H' rotated 90 degrees relative to the body such that a pair of flaps are formed on the body. The flaps are inserted into the slits on the panel member and clasp the back side of the panel member for sliding along the slit and marking the line where the user was previously reading.

According to another feature of the present invention, the slit includes a pair of parallel slits on the panel member and the line indicator body includes a plurality of folds forming a pair of flaps. The flaps are inserted into the slits on the panel member and clasp the back side of the panel member for sliding along the slit and marking the line where the user was previously reading.

According to another feature of the present invention, the slit includes a pair of parallel slits having a ribbon secured between the slits.

According to another feature of the present invention, the line indicator body includes a pair of parallel slits. The ribbon is inserted through the slits on the body and secured to the panel member for sliding along the ribbon and marking the line where the user was previously reading.

According to another feature of the present invention, the line indicator body includes a plurality of folds forming a pair of flaps on the body. The flaps are inserted into the slit on the panel member and clasp the back side of the panel member for sliding along the slit and marking the line where the user was previously reading.

According to another feature of the present invention, the line indicator body, the front side and the opposite back side of the panel member includes decorative designs.

According to another feature of the present invention, the line indicator body is polygonal in shape.

According to another feature of the present invention, the line indicator body is shaped to form an arrow for pointing to that exact line where the user was previously reading.

According to another feature of the present invention, the line indicator body has a width less than the panel member such that the line indicator body is contained within the panel member.

According to another feature of the present invention, a method for indicating to a user the location where the user was previously reading in a piece of the literature having a plurality of pages and a plurality of lines is provided. The method includes providing a panel member having a top end, a bottom end, a front side and an opposite back side for positioning between the plurality of pages. Aligning a position indicator being located on the front side near the top end of the panel member for indicating to the user where to position the panel member on the page. Creating at least one slit on the panel member. Attaching a line indicator being slidably mounted on the front side of the panel member using the at least one slit. And, using the line indicator to mark the line where the user was previously reading by sliding the line indicator along the panel member.

One or more of these and/or other objectives will become apparent from the following specification and claims.

DETAILED DESCRIPTION OF THE DRAWINGS

Figures 1A, 1B, 1C, 1D, 1E:
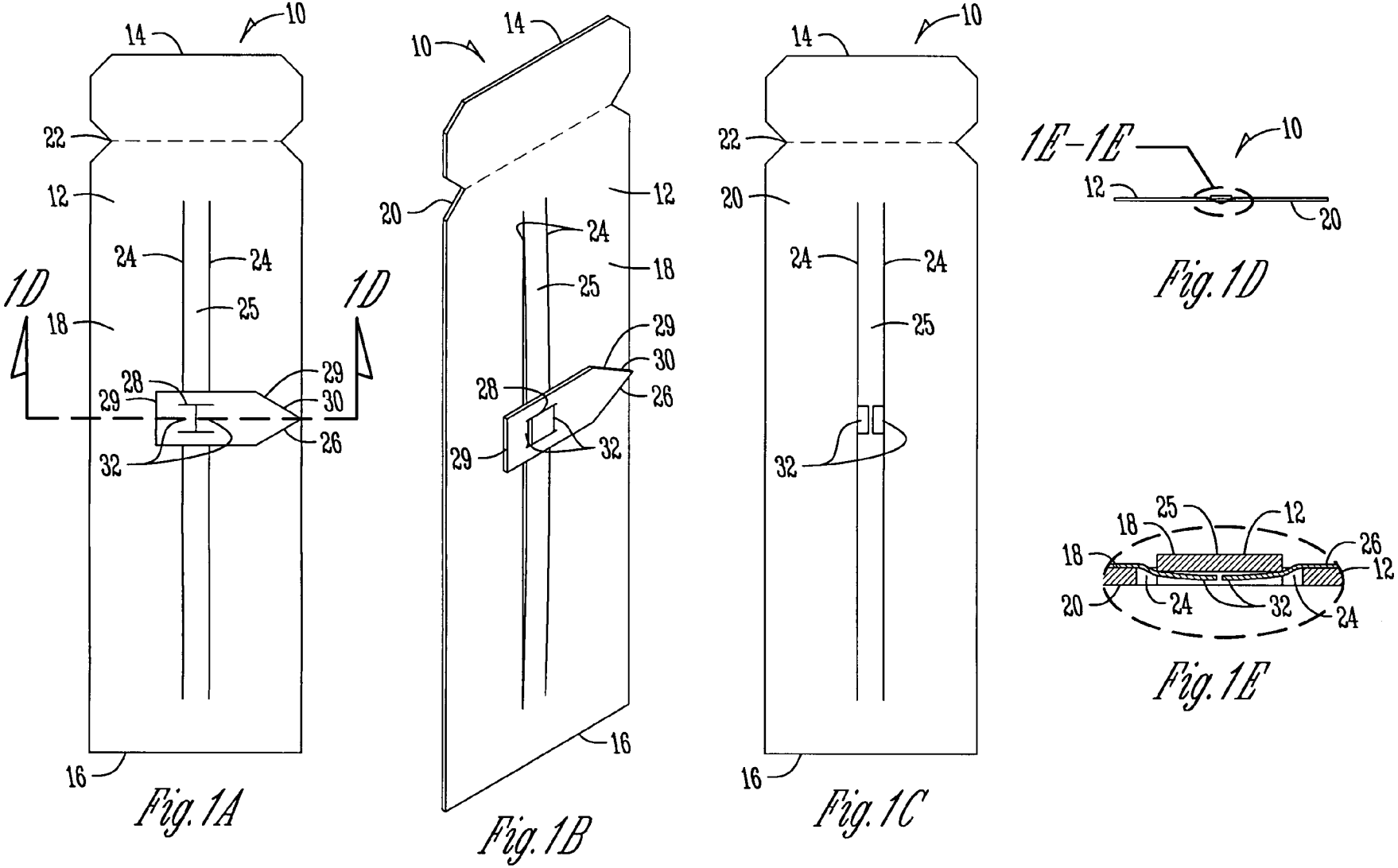
FIG. 1A is a top view of one embodiment of the bookmark.
FIG. 1B is an isometric view of the line indicator.
FIG. 1C is a bottom view of one embodiment of the bookmark.
FIG. 1D is a cross sectional view of one embodiment of the bookmark taken along lines 1D-1D in FIG. 1A.
FIG. 1E is an exploded view of one embodiment of the bookmark taken along lines 1E-1E in FIG. 1D.

As seen in FIG. 1, the numeral 10 refers generally to the improved bookmark. The bookmark 10 is comprised generally of a panel member 12. The panel member 12 has a top end 14, bottom end 16, front side 18 and opposite back side 20. The panel member 12 is for positioning between the plurality of pages in a piece of literature. A position indicator 22 is located on the panel member 12 near the top end 14. The position indicator 22 is for indicating to the user where to position the panel member 12 on the page.

FIG. 1A is a top view of one embodiment of the bookmark. In FIG. 1A, the panel member 12 is shown as having a pair of parallel slits 24. The slits 24 are created in the panel member 12 and run the length of the panel member 12. The slits 24 start near the bottom end 16 of the panel member 12 and end near the position indicator 22. The slits 24 pass through the body of the panel member 12. The slits 24 allow for an efficient and economical means of attaching the line indicator body 26 to the panel member 12. The line indicator body 26 includes a plurality of slits 28 forming the shape of the letter 'H' rotated 90° relative to the length of the line indicator body 26. The slits 28 pass through the line indicator body 26 from the top side to the bottom side. The slits 28 form a pair of flaps 32 on the body 26. The line indicator body 26 has an outer periphery consisting of ends 29 and pointer 30. The pointer 30 is for indicating or marking the line where the user was previously reading within the piece of literature. The line indicator body 26 is connected to a strip 25 of the panel member 12 between the parallel slits 24 on the panel member 12. This is done by opening the pair of flaps 32 and wrapping them around the back side between the pair of slits 24 on the panel member 12, as best illustrated by FIG. 1C. Thus, the flaps 32 provide a sturdy, economical and efficient means of attaching the line indicator body 26 to the panel member 12. FIG. 1E illustrates in greater detail and is a cross sectional view of one embodiment of the bookmark taken along lines 1E-1E in FIG. 1D. In FIG. 1E, the pair of flaps 32 are shown extending from the top side 18 of the panel member 12 through the pair of parallel slits 24 and on the bottom side 20 of the panel member 12 beneath the strip 25. Thus, flaps 32 clasp the back side 20 of the strip 25 to keep the line indicator body 26 slidably attached to the panel member 12 for marking the line where the user was previously reading in the literature. The line indicator body 26 is polygon in shape and has a pointed region 30 for pointing to the exact line where the user was previously reading in the literature. The line indicator body 26 is purposely designed to have a width extending between the two ends 29 on the body 26 less than the width of the panel member 12 so that the line indicator body 26 is contained within the outer periphery of the panel member 12. By use of the flaps 32 and in keeping the line indicator body 26 within the outer periphery of the panel member 12 prevents unwanted shifting or translation of the line indicator body 26 with respect to the panel member 12. Although the panel member 12 may shift or move from its original place positioned between the pages of the literature, the line indicator body 26 will remain in the same spot with respect to the panel member 12. Thus, the user realigns the panel member 12 with the page using the position indicator 22 to mark the exact line where the user was previously reading.

Figures 2A, 2B, 2C, 2D, 2E:
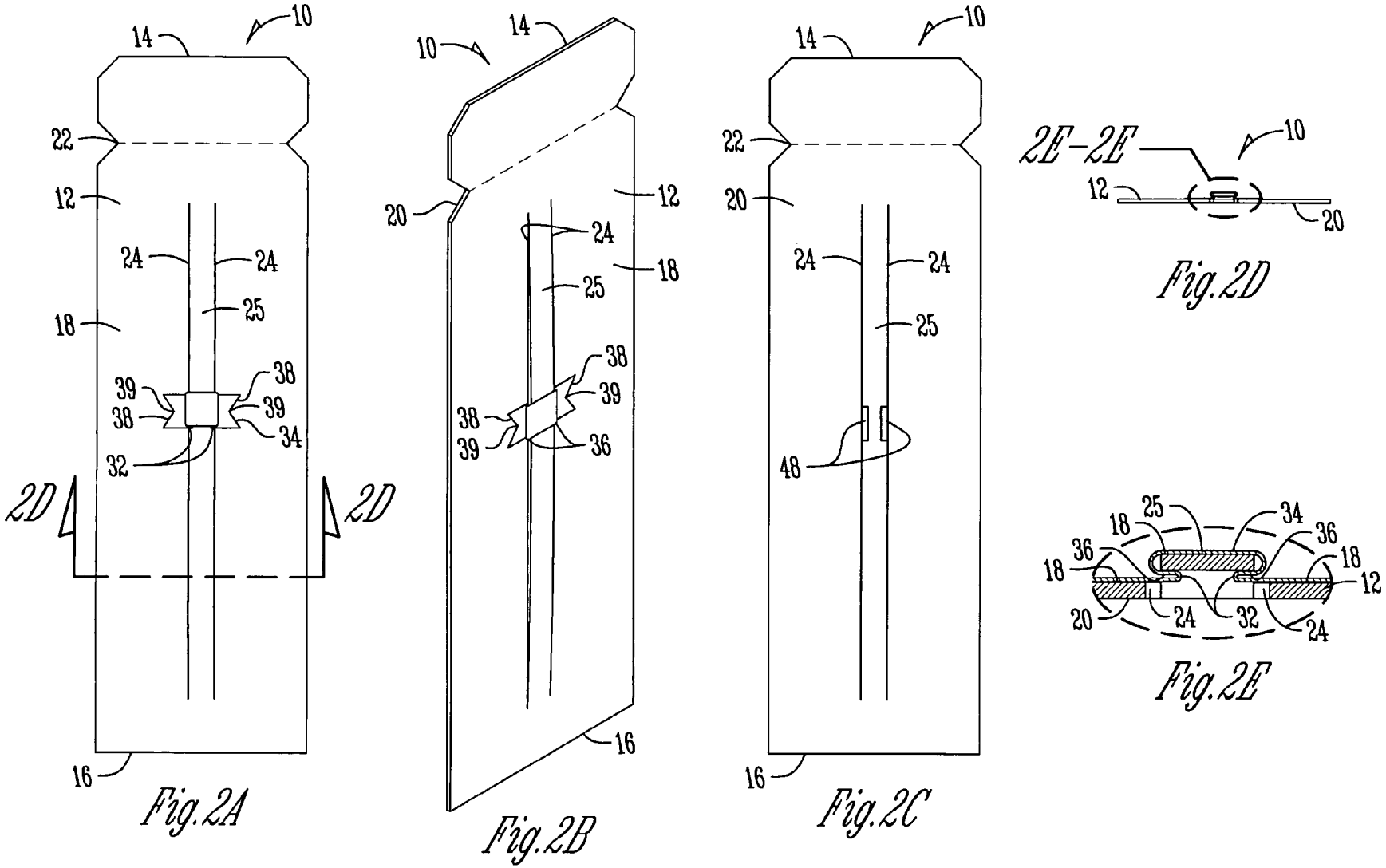
FIG. 2A is a top view of another embodiment of the bookmark.
FIG. 2B is an isometric view of the line indicator.
FIG. 2C is a bottom view of another embodiment of the bookmark.
FIG. 2D is a cross sectional view of another embodiment of the bookmark taken along lines 2D-2D in FIG. 2A.
FIG. 2E is an exploded view of another embodiment of the bookmark taken along lines 2E-2E in FIG. 2D.

FIG. 2A is a top view of another embodiment of the bookmark. In FIG. 2A, the panel member 12 contains the same features as the panel member 12 illustrated in FIG. 1A. In FIG. 2B an additional embodiment of the line indicator body 34 is shown. The line indicator body 34 has ends 38 and pointer 39. The line indicator body 34 also has a top and bottom parallel sides between ends 38. A pair of flaps 32 are formed with the line indicator body 34 as a means of attaching the line indicator body 34 to the strip 25. How the line indicator body 34 is attached to the panel member 12 is best illustrated in FIG. 2E. In FIG. 2E, the line indicator body 34 is shown having a pair of flaps 32. The line indicator body 34 is folded so that the pair of flaps 32 extend through the pair of slits 34 and along the bottom side 20 of the strip 25. The flaps 32 secure the line indicator body 34 to the panel member 12. The line indicator body 34 may be slid along the strip 25 for marking the line where the user was previously reading within the literature. The line indicator body 34 and pair of flaps 32 provide an economical, efficient and yet sturdy means of attaching the line indicator body 34 to the strip 25 of panel member 12. The line indicator body 34 is polygonal in shape and has ends 38 forming a pointer 39 for indicating to the user the exact line where the user was previously reading. The line indicator body 34 has a width between ends 38 less than the width of the panel member 12 such that the line indicator body 34 is contained with the outer periphery of the panel member 12. Limiting the surface area of the line indicator body 34 prevents unwanted shifting or translation of the line indicator body 34 with respect to the panel member 12. Thus, when a user resumes reading from the literature, though the panel member 12 may have shifted with respect to the page, the line indicator body 34 has not shifted. The user is then able to reposition the panel member 12 on the page using the position indicator 22 to indicate to the user where the user was previously reading on the page.

Figures 3A, 3B, 3C, 3D, 3E:
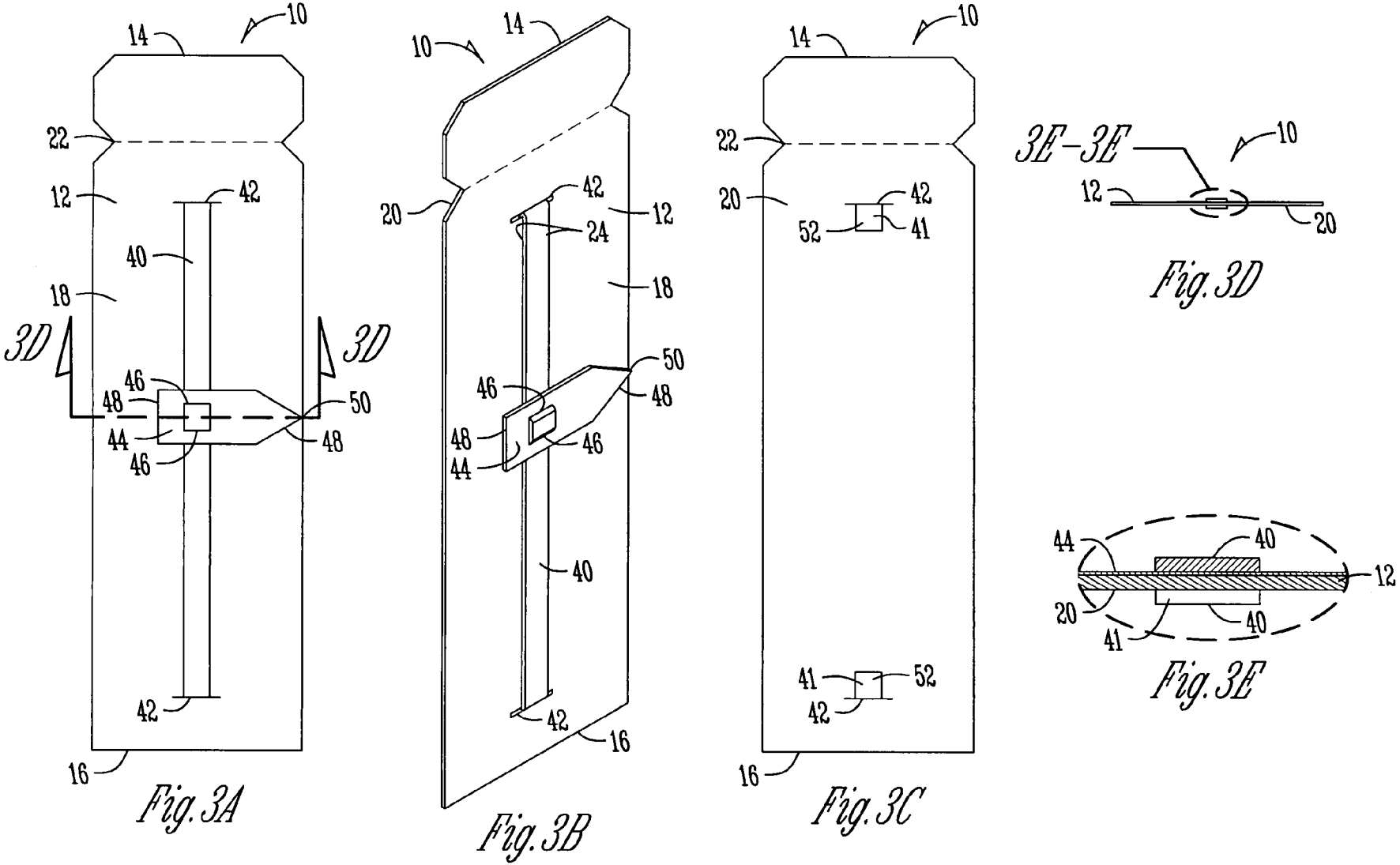
FIG. 3A is a top view of another embodiment of the bookmark.
FIG. 3B is an isometric view of the line indicator.
FIG. 3C is a bottom view of another embodiment of the bookmark.
FIG. 3D is a cross sectional view of another embodiment of the bookmark taken along lines 3D-3D in FIG. 3A.
FIG. 3E is an exploded view of another embodiment of the bookmark taken along lines 3E-3E in FIG. 3D.

FIG. 3A is a top view of another embodiment of the bookmark. In FIG. 3A, a panel member 12 consists of a top end 14, a bottom end 16, a front side 18 and an opposite back side 20. The panel member 12 also has a position indicator 22 located near the top end 14 of the panel member 12. The position indicator 22 for use in realigning the panel member 12 with the page of the literature. Positioned on the panel member 12 are a pair of parallel slits 42. The slits 42 pass through the panel member 12 from the top side 18 to the bottom side 20. A first slit 42 is positioned near a bottom end 16 of the panel member 12. A second slit 42 is positioned near the position indicator 22. A ribbon 40 is secured between the pair of parallel slits 42. The ends of the ribbon 41 are threaded through the pair of parallel slits 42 on the panel member 12 and secured at attaching points 52 on the back side 20 of the panel member 12, as best illustrated in FIG. 3C. The line indicator body 44, as shown in FIG. 3B, is polygonal in shape. The line indicator body 44 has a top side and bottom side and ends 48 defining the width of the indicator body 44. The indicator body 44 also has an arrow shape 50 on the end 48 for indicating to the user where the user was previously reading in the literature. On the line indicator body 44 is a pair of parallel slits 46. The slits 46 pass through the line indicator body 44 from the top to the bottom side. The parallel slits 46 allow the ribbon 40 to be threaded through the slits 46 on the indicator body 44. This is done by inserting the ribbon end 41 into the slit 46 on the bottom side of the indicator body 44 over the top of the line indicator body 44 between the pair of parallel slits 46 and back through the slit 46 and along the underside of the indicator body 44. The ribbon 40 is then connected to the panel member 12 at attaching points 52 on the back side 20 of the panel member 12, as shown in FIG. 3E. The width of the line indicator body 44 extending between ends 48 is less than the width of the panel member 12 so that the line indicator body 44 is contained within the outer periphery of the panel member 12. The line indicator body 44 is slid along the ribbon 40 between the pair of parallel slits 42 on the panel member 12. Thus, the user is able to slide the line indicator body 44 along the ribbon 40 to mark the line where the user was previously reading. The ribbon 40 provides a secure and rigid means of affixing the line indicator body 44 to the panel member 12 so that the line indicator body 44 resists unwanted translation or movement along the ribbon 40. Though the panel member 12 may shift or move with respect to page, the line indicator body 44 retains its position with respect to the panel member 12 for marking the line where the user was previously reading.

Figure 4D:
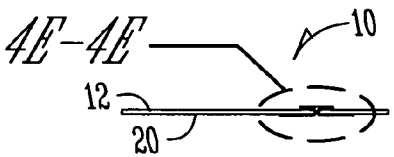
FIG. 4D is a cross sectional view of another embodiment of the bookmark taken along lines 4D-4D in FIG. 4A.
Figure 4E:
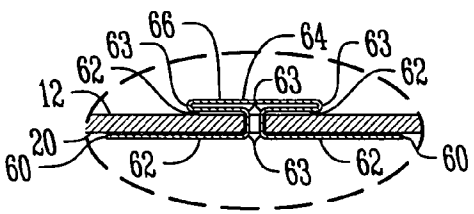
FIG. 4E is an exploded view of one embodiment of the bookmark taken along lines 4E-4E in FIG. 4D.
Figure 4C:
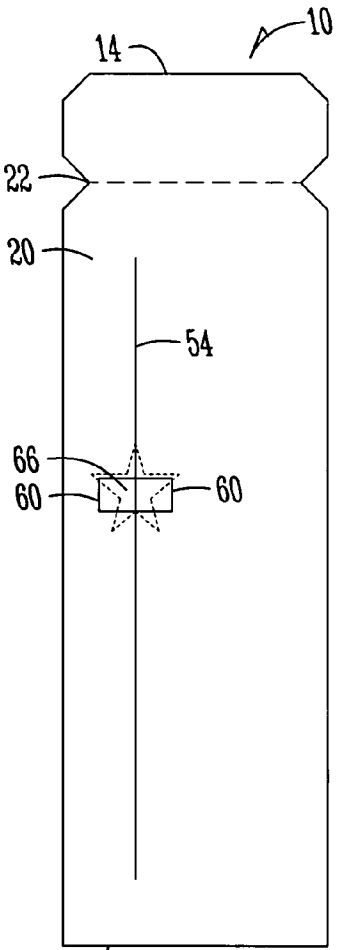
FIG. 4C is a bottom view of another embodiment of the bookmark.
Figure 4B:
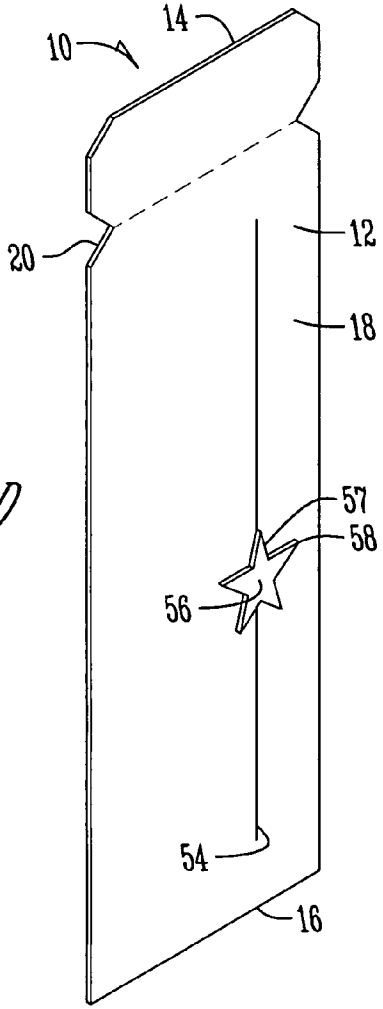
FIG. 4B is an isometric view of the line indicator.
Figure 4A:
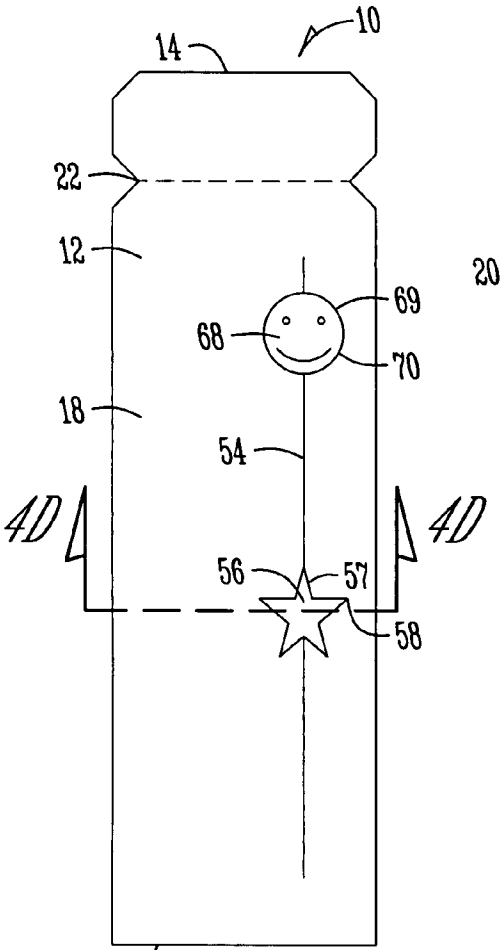
FIG. 4A is a top view of another embodiment of the bookmark.

FIG. 4A is a top view of another embodiment of the bookmark. In FIG. 4A, the panel member 12 has a single slit 54 running perpendicular to the top end 14 and the opposite bottom end 16 of the panel member 12. The slit 54 starts near the bottom end 16 and ends near the position indicator 22 near the top 14 of the panel member 12. Line indicator bodies 56 and 68 are shown in FIG. 4A. Indicator bodies 56, 68 are illustrative of the fact that numerous shapes and designs could be employed when fabricating the line indicator body. For example, the user may prefer the decorative design of the line indicator body 68 being a smiley face as illustrate in FIG. 4A. Or, the user may prefer the decorative design of a star as the indicator body 56 also shown in FIG. 4A. Whatever the design preferred by the user, only one line indicator body on the panel member would be necessary for marking the line or indicating to the user where the user was previously reading. Generally indicia located on the front 18 and/or back 20 of the panel member 12 could match the decorative design used to fabricate the line indicator body. Whether using line indicator body 56 or 68, attachment 66 secures the body to the panel member 12. The attachment 66 includes a plurality of folds 63 forming a pair of flaps 62. The line indicator body 56, 68 are attached to the panel member 12 by inserting ends 60 through slit 54 such that flaps 62 grasp both the front side 18 and the back side 20 of the panel member 12 thereby allowing the line indicator body 56 to be slid along the slit 54 for marking the line where the user was previously reading. The attachment 66, as best shown in FIG. 4E, is a strong, economical and sturdy means of attaching the line indicator body to the panel member 12. In keeping with the design of the other embodiments, the line indicator body 56, 68 and attachment 66 have a width less than the width of the panel member 12 so that the line indicator body 56, 68 are contained within the outer periphery of the panel member 12. As previously noted, keeping the width of the line indicator body within the width of the panel member 12 prevents the line indicator body from being shifted unintentionally or by mishap along the slit 54. In addition, position indicator 22 allows the user to reposition the panel member 12 on the page so that the line indicator body 56 or 68 indicates to the user where the user was previously reading.

The present invention contemplates numerous other options and design and use of the improved bookmark. It is to be understood, for example, that the line indicator bodies need not exhibit any particular shape or have a pointer contained thereon. It is also to be understood that the line indicator body may be manufactured separately from the attachment means used to secure or affix the line indicator body to the panel member. Also, the present invention contemplates variations in the type of indicia used on the panel member for presenting a theme in the decorative design and tying the design of the line indicator body to the panel member. Although it is preferred that the line indicator body have a decorative design and the panel member also exhibit decorative designs along with similar indicia, the panel member and the line indicator body need not. Also, the present invention contemplates indicia and decorative designs positioned on the panel member and line indicator body corresponding to the piece of literature.

These and other options, variations, are all within the spirit and scope of the invention.

What is claimed is:

1. A bookmark for indicating to a user the location where the user was previously reading in a piece of the literature having a plurality of pages and a plurality of lines, the bookmark comprising:

a panel member having a top end, a bottom end, a front side and an opposite back side for positioning between the plurality of pages, and a first pair of parallel slits;

a ribbon having two ends, each of the ends extending through a respective one of the first pair of slits and secured to the panel member;

a position indicator being located on the front side near the top end of the panel member for indicating to the user where to position the panel member on the page; and a line indicator body having a second pair of parallel slits and being slidably mounted on the ribbon with the ribbon extending through the second pair of parallel slits;

wherein the line indicator marking the line where the user was previously reading by sliding the line indicator body along the ribbon.

2. The bookmark of claim 1 wherein the line indicator body, the front side and the opposite back side of the panel member includes decorative designs.

3. The bookmark of claim 1 wherein the line indicator body is polygonal in shape.

4. The bookmark of claim 1 wherein the line indicator body is shaped to form an arrow for pointing to that exact line where the user was previously reading.

5. The bookmark of claim 1 wherein the line indicator body has a width less than the panel member such that the line indicator body is contained within the panel member.

6. A method for indicating to a user the location where the user was previously reading in a piece of the literature having a plurality of pages and a plurality of lines, the method comprising:

providing a bookmark including a panel member having a top end, a bottom end, a front side and an opposite back side for positioning between the plurality of pages, and a first pair of parallel slits, a ribbon having two ends, each of the ends extending through a respective one of the first pair of slits and secured to the panel member, a position indicator being located on the front side near the top end of the panel member for indicating to the user where to position the panel member on the page, and a line indicator body having a second pair of parallel slits and being slidably mounted on the ribbon with the ribbon extending through the second pair of parallel slits;

positioning the position indicator on the page; and marking the line where the user was previously reading by sliding the line indicator body along the ribbon.

7. The method of claim 6 wherein the line indicator body is shaped to form an arrow for pointing to that exact line where the user was previously reading.

8. The bookmark of claim 6 wherein the line indicator body has a width less than the panel member such that the line indicator body is contained within the panel member.

* * * * *